US009469926B2

(12) United States Patent
Lu

(10) Patent No.: US 9,469,926 B2
(45) Date of Patent: Oct. 18, 2016

(54) METHOD OF MANUFACTURING FABRIC WITH COOL EFFECT

(71) Applicant: GRAND TEXTILE CO., LTD., New Taipei (TW)

(72) Inventor: Jen-Huan Lu, New Taipei (TW)

( * ) Notice: Subject to any disclaimer, the term of this patent is extended or adjusted under 35 U.S.C. 154(b) by 301 days.

(21) Appl. No.: 14/071,868

(22) Filed: Nov. 5, 2013

(65) Prior Publication Data

US 2014/0057049 A1 Feb. 27, 2014

Related U.S. Application Data

(63) Continuation-in-part of application No. 13/102,088, filed on May 6, 2011, now abandoned.

(51) Int. Cl.

| | |
|---|---|
| ***D06C 7/02*** | (2006.01) |
| ***D06M 11/44*** | (2006.01) |
| ***D06M 11/79*** | (2006.01) |
| ***D06M 15/263*** | (2006.01) |
| ***D06M 15/564*** | (2006.01) |
| ***D06M 23/04*** | (2006.01) |
| ***D06N 3/00*** | (2006.01) |
| ***D06N 3/14*** | (2006.01) |

(52) U.S. Cl.

CPC ..... *D06C 7/02* (2013.01); *D06M 11/44* (2013.01); *D06M 11/79* (2013.01); *D06M 15/263* (2013.01); *D06M 15/564* (2013.01); *D06M 23/04* (2013.01); *D06N 3/005* (2013.01); *D06N 3/0047* (2013.01); *D06N 3/0063* (2013.01); *D06N 3/14* (2013.01); *D06N 2209/123* (2013.01)

(58) Field of Classification Search

CPC ..... D06M 15/564–15/579

See application file for complete search history.

(56) References Cited

U.S. PATENT DOCUMENTS

| | | | | |
|---|---|---|---|---|
| 3,574,646 | A | 4/1971 | Wismer et al. | 501/82 |
| 3,981,820 | A | 9/1976 | Miller et al. | 252/301.16 |
| 5,204,403 | A | 4/1993 | Furuta et al. | 524/493 |
| 5,512,319 | A * | 4/1996 | Cook | D06N 3/14 264/45.6 |
| 2002/0197396 | A1 | 12/2002 | Haggquist | 427/180 |

* cited by examiner

*Primary Examiner* — Alex A Rolland

(57) ABSTRACT

A method of manufacturing fabric includes adding 900 g of a material having a 92 wt % of $SiO_2$ and 5 wt % of zinc oxide (ZnO) and 1,500 g of PU resin to water to mix until a first solution is formed; pouring the first solution into a first foaming tank; agitating the first solution in the first foaming tank to foam; adding a bridging agent and a foaming agent to a second foaming tank to mix with water to foam until a second solution is formed; pouring the first and second solutions into a third tank to mix and form a coating solution; continuously conveying a fabric sheet to a top of a platform; activating squeegees to spread the coating solution on the fabric sheet to form a cooling layer thereon; and performing a dry setting finish on the fabric sheet.

3 Claims, 7 Drawing Sheets

| Test Items | Touch feeling of warmth or coolness<br>Q-max ($W/cm^2$) |
|---|---|
| Test results | 0.119 |
| Test methods | FTTS-FA-019-2010<br>25±2℃, 65±5%RH |
| Sample description | Knitted fabric |

FIG. 3

| Test Items | | Test Results | Test Methods |
|---|---|---|---|
| Wetting Time (s) | Top surface | 3 | AATCC 195-2011<br>21±1℃, 65±2%RH |
| | Bottom surface | 3 | |
| Absorption rate (%/s) | Top surface | 30 | |
| | Bottom surface | 50 | |
| Maximum wetted radius (mm) | Top surface | 25 | |
| | Bottom surface | 26 | |
| Spreading speed (mm/s) | Top surface | 5.3 | |
| | Bottom surface | 5.6 | |
| Accumulative One-Way Transport Index (%) | | 309 | |
| OMMC | | 0.74 | |
| Sample description: Knitted fabric | | | |

FIG. 4

| Test Items | Touch feeling of warmth or coolness<br>Q-max ($W/cm^2$) |
|---|---|
| Test results | 0.196 |
| Test methods | FTTS-FA-019-2010<br>25±2℃, 65±5%RH |
| Sample description | Woven fabric: 50%NYLON 9%CD 41%POLY<br>WIDTH: 57/58 |

FIG. 6

| Test Items | Touch feeling of warmth or coolness<br>Q-max ($W/cm^2$) |
|---|---|
| Test results | 0.169 |
| Test methods | FTTS-FA-019-2010<br>25±2℃, 65±5%RH |
| Sample description | Woven fabric: 100%NYLON DOBBY WIDTH: 57 |

FIG. 7

| Test Items | Touch feeling of warmth or coolness<br>Q-max ($W/cm^2$) (Woven fabric) |
|---|---|
| Test results | 0.144 |
| Test methods | FTTS-FA-019-2010<br>25±2℃, 65±5%RH |
| Sample description | Woven fabric: 100%NYLON 6*6 RIB STOP<br>WIDTH: 56 |

FIG. 8

METHOD OF MANUFACTURING FABRIC WITH COOL EFFECT

BACKGROUND OF THE INVENTION

1. Field of the Invention

The invention relates to fabric manufacturing and, more particularly, to a method of manufacturing fabric with cool effect so that a wearer may feel a degree of coolness when wearing clothes made of such fabric.

2. Description of Related Art

It is well known that some types of clothing are made of fabric having poor vapor permeability. Often times, a person wearing clothes made of such fabric may feel uncomfortable especially in hot summer days, because perspiration cannot be carried away from the skin.

There are many so-called "breathable" clothes commercially available. However, a person wearing the clothes may not have the feeling of comfort as desired. Further, there is prior literature about "cool fabric". Such fabric can be made by adding a material with cool effect to fibers, spinning the fibers into threads, and further, for example, weaving. However, its manufacturing process including the grinding of cool material and the addition of the material to the fibers is very complex and cost ineffective, and, further, its quality is not as good as desired. Thus, the need for improvement still exists.

SUMMARY OF THE INVENTION

It is therefore one object of the invention to provide a method of manufacturing fabric comprising the steps of method of manufacturing fabric comprising the steps of adding 900 g of a material having a 92 wt % of silicone dioxide ($SiO_2$) and 5 wt % of zinc oxide (ZnO) and 1,500 g of polyurethane (PU) resin to water to mix until a first solution of 30 liter is formed; pouring the first solution into a first foaming tank; agitating the first solution in the first foaming tank to foam; adding a bridging agent and a foaming agent to a second foaming tank to mix with water to foam until a second solution having a volume of 100 liter is formed; pouring the first and second solutions into a third tank to mix and form a coating solution; continuously conveying a fabric sheet to a top of a platform; activating a squeegee to spread the coating solution on the fabric sheet to form a cooling layer; and performing a dry setting finish on the fabric sheet coated with the cooling layers.

The above and other objects, features and advantages of the invention will become apparent from the following detailed description taken with the accompanying drawings.

BRIEF DESCRIPTION OF THE DRAWINGS

FIG. 3 tabulates sample and test methods regarding the touch feeling of warmth or coolness test of the Knitted fabric containing 92 wt % of silicone dioxide ($SiO_2$) and 5 wt % of zinc oxide (ZnO);

FIG. 4 tabulates sample and test methods regarding the wetting time, absorption rate, maximum wetted radius, spreading speed, accumulative one-way transport index (%) and OMMC test of the Knitted fabric containing 92 wt % of silicone dioxide ($SiO_2$) and 5 wt % of zinc oxide (ZnO);

FIG. 6 tabulates sample and test methods regarding the touch feeling of warmth or coolness test of the woven fabric (50% NYLON 9% CD 41% POLY WIDTH: 57/58) containing 92 wt % of silicone dioxide ($SiO_2$) and 5 wt % of zinc oxide (ZnO);

FIG. 7 tabulates sample and test methods regarding the touch feeling of warmth or coolness test of the woven fabric (100% NYLON DOBBY WIDTH: 57) containing 92 wt % of silicone dioxide ($SiO_2$) and 5 wt % of zinc oxide (ZnO);

FIG. 8 tabulates sample and test methods regarding the touch feeling of warmth or coolness test of the woven fabric (100% NYLON 6*6 RIB STOP WIDTH: 56) containing 92 wt % of silicone dioxide ($SiO_2$) and 5 wt % of zinc oxide (ZnO);

DETAILED DESCRIPTION OF THE INVENTION

Figure 1:
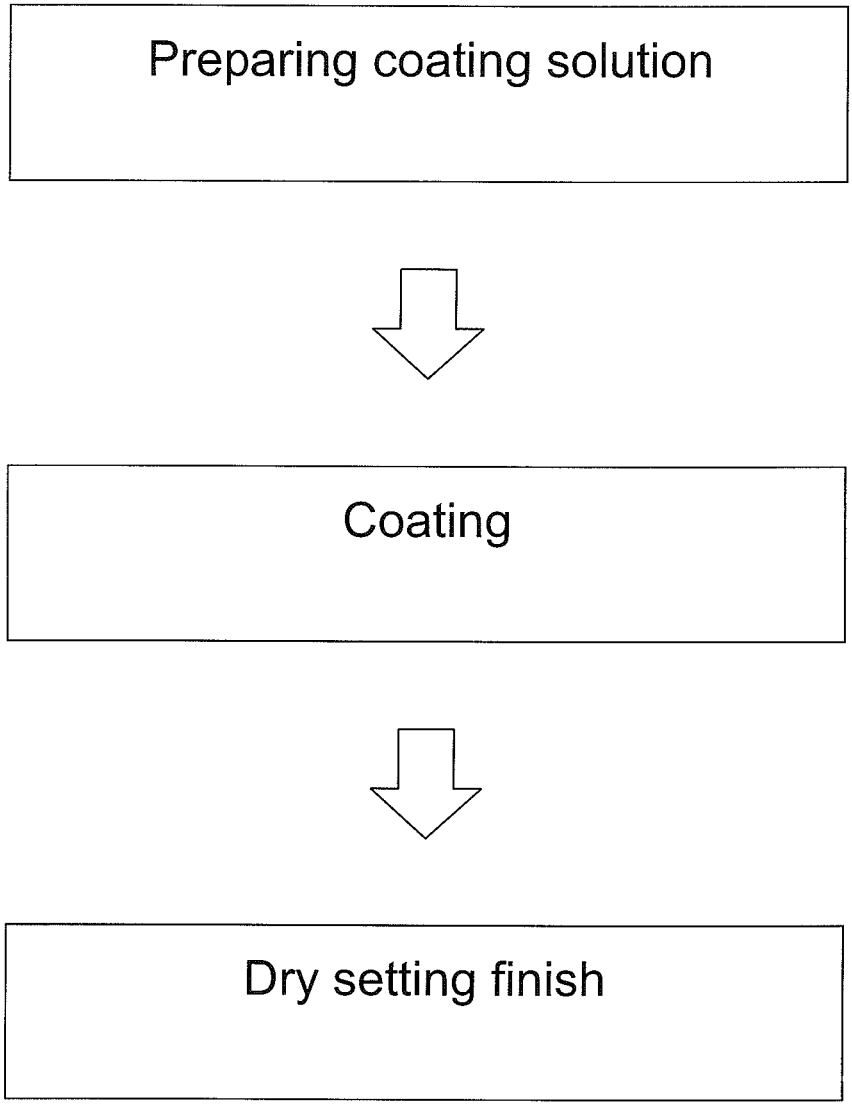
FIG. 1 is a flow chart diagram of a method of manufacturing fabric with cool effect according to the invention.
Figure 2:
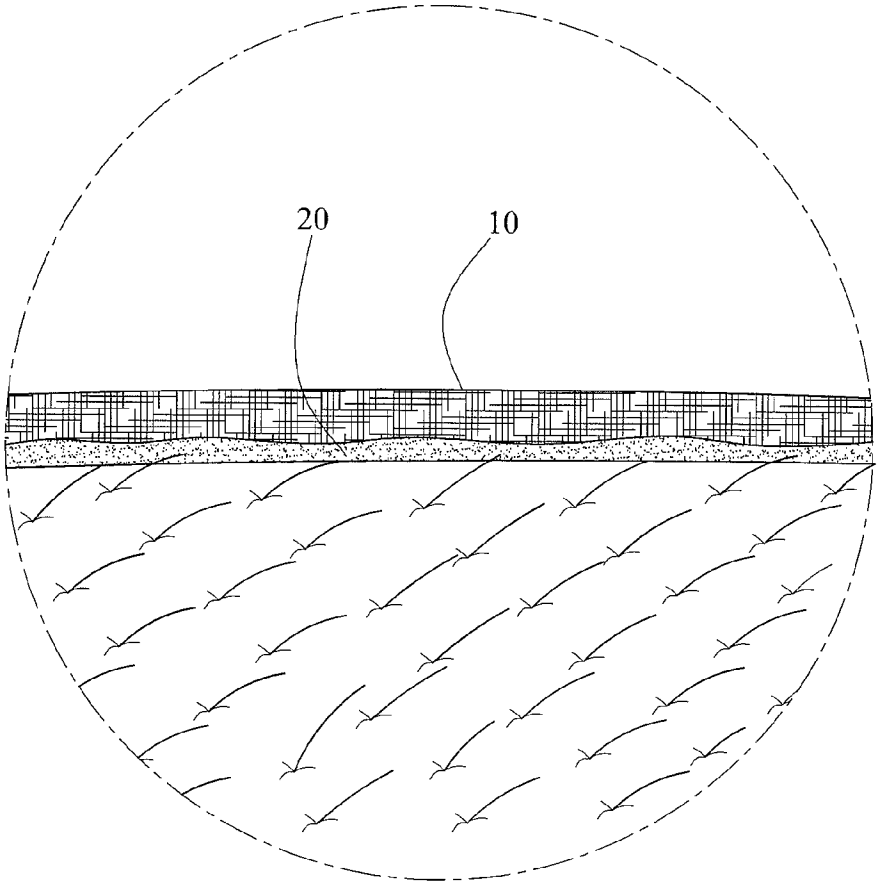
FIG. 2 is a perspective view of a piece of fabric made by the method of the invention.

Referring to FIGS. 1 and 2, a method of manufacturing fabric with cool effect in accordance with the invention is illustrated below. The method comprises the following steps:

In step S1, 900 g of material having a 92 wt % of silicone dioxide ($SiO_2$) and 5 wt % of zinc oxide (ZnO) and 1,500 g of polyurethane (PU) resin are added to water to mix as a solution of 30 liter. The solution is poured into a first foaming tank. A powerful pump is employed to agitate the solution for quick foaming. A bridging agent and a foaming agent are added to a second foaming tank to mix with water for quick foaming having a volume of 100 liter. The bridging agent is PU resin (e.g., CAS No: 26680-22-8).

Quantity of the added bridging agent is 2-5% of a sum of volume of the first foaming tank and volume of the second foaming tank. The foaming agent is 3,7-dinitroso-1.3.5.7-tetraazobicyclo-nonane N,N, CAS No: 101-25-7, or azodicarbonamide CAS No:123-77-3. Quantity of the foaming agent is 1-3% of volume of the second foaming tank.

In step S2, pouring solutions in both the first and second foaming tanks into a third tank to mix and form a coating solution. A fabric sheet 10 is continuously conveyed to a top of a platform. A squeegee is employed to spread the coating solution on the fabric sheet 10. As a result, the fabric sheet 10 is formed with a cooling layer 20. When a wearer wears clothes made of the fabric, the cooling layer 20 contacts with the wearer skin.

Preferably, the fabric sheet has low water absorbability.

In step S3, a dry setting finish is performed on the fabric sheet 10 coated with the cooling layers 20.

The fabric having cooling layers formed by foam coating has the following advantages:

Increased moisture permeability and breathability: This is because the fabric having apertures formed therein (i.e., porous) can quickly transmit air and moisture. As a result, a wearer may feel a degree of cooling when wearing clothes made of the fabric.

Increased softness: This is because the cooling layers 20 are porous and can absorb an increased quantity of moisture with good absorbing capability. As a result, a wearer may feel a degree of cooling when wearing clothes made of the fabric.

Increased difficulty of permeating rubber: A decreased pressure is sufficient to spread the coating solution to the fabric because the coating solution having PU resin with increased adhesiveness.

Wide applications: The cooling layer has a thickness less than that of a conventional coating and the fabric can be employed as knitted fabric of low strain or thick woven fabric.

Figure 5:
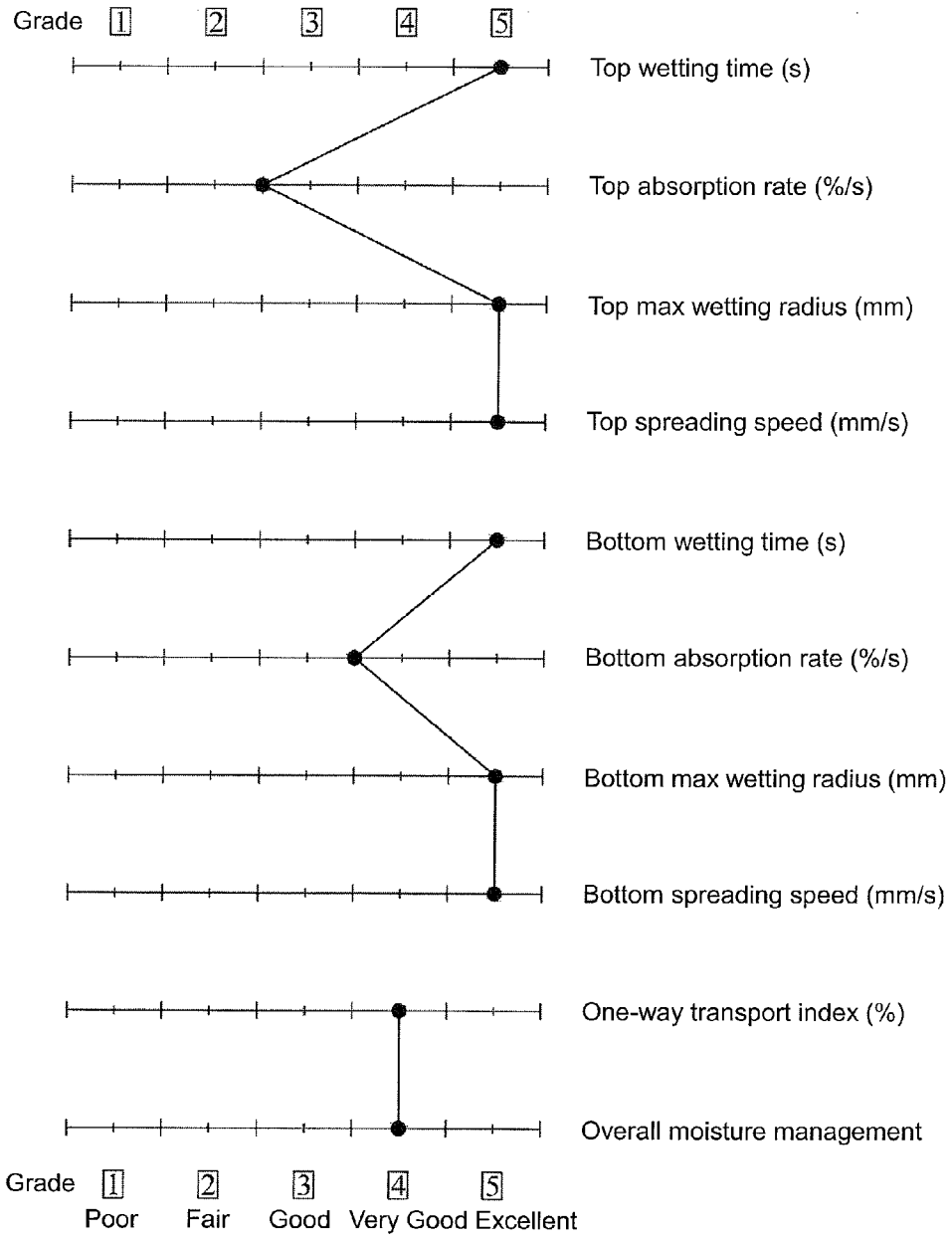
FIG. 5 shows test grade with respect to the test table of FIG. 4.

Referring to FIGS. 3 to 5, knitted fabric containing 92 wt % of silicone dioxide ($SiO_2$) and 5 wt % of zinc oxide (ZnO) of the invention has been tested by TTRI (Taiwan Textile Research Institute). As shown in FIG. 4 and FIG. 5, knitted fabric's bottom surface with cooling layers has good moisture permeability and knitted fabric's top surface without cooling layers has low water absorbability. And referring to FIGS. 6 to 8 different woven fabrics containing 92 wt % of silicone dioxide ($SiO_2$) and 5 wt % of zinc oxide (ZnO) of the invention have been tested by TTRI (Taiwan Textile Research Institute). Woven fabrics containing 92 wt % of silicone dioxide ($SiO_2$) and 5 wt % of zinc oxide (ZnO) show excellent coolness feeling about 0.144 to 0.196 $W/cm^2$ (The average value about touch feeling of warmth or coolness in Asia is about 0.14 $W/cm^2$). In conclusion, both knitted and woven fabric containing 92 wt % of silicone dioxide ($SiO_2$) and 5 wt % of zinc oxide (ZnO) show excellent water absorbency, breathability, and coolness feeling.

Figure 9:
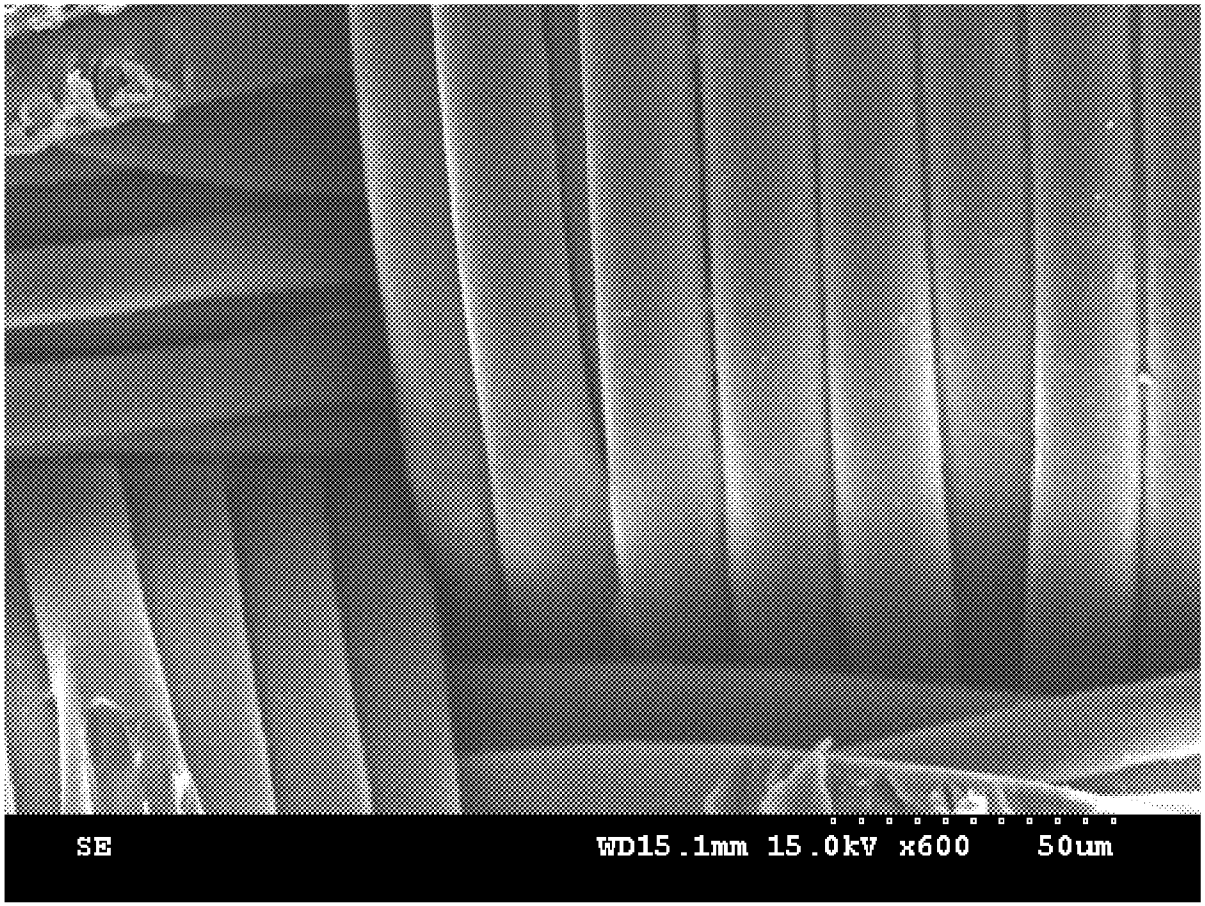
FIG. 9 is a photograph of the fabric of FIG. 2 being magnified 600 times.
Figure 10:
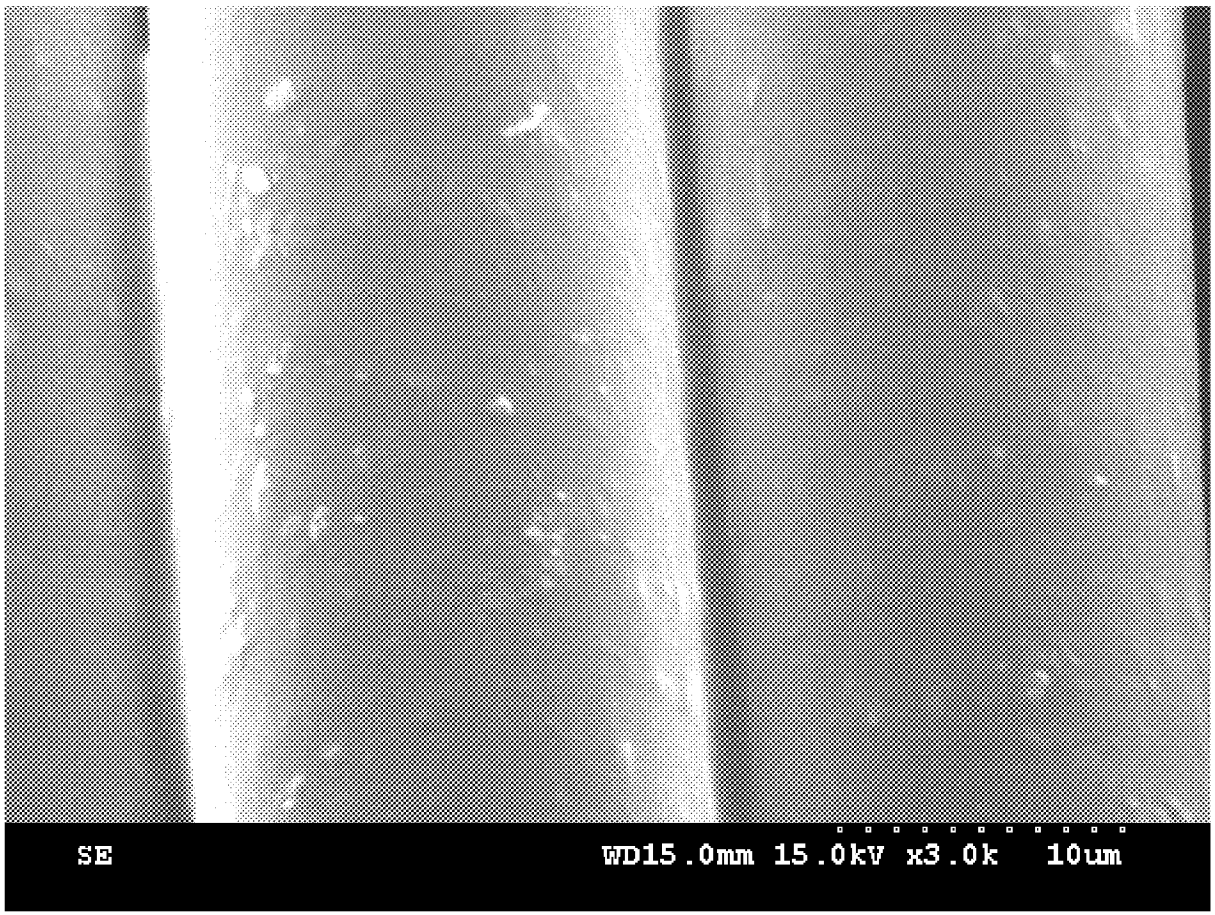
FIG. 10 is a photograph of the fabric of FIG. 2 being magnified 3,000 times.

Referring to FIGS. 9 and 10, two photographs of the fabric of the invention are magnified 600 times and 3,000 times respectively. It is envisaged by the invention that a wearer may feel a degree of coolness when wearing clothes made of the fabric. Moreover, the fabric has an antibacterial effect due to the inclusion of zinc oxide powder of nanometer scale or silver powder of nanometer scale. Further, the method is easy to implement, and mass production can be carried out with the manufacturing cost being greatly reduced.

While the invention has been described in terms of the preferred embodiments, those skilled in the art will recognize that the invention can be practiced with modifications within the spirit and scope of the appended claims.

What is claimed is:

1. A method of manufacturing fabric comprising the steps of:

adding 900 g of a material having a 92 wt % of silicon dioxide ($SiO_2$) and 5 wt % of zinc oxide (ZnO) and 1,500 g of polyurethane (PU) resin to water to mix until a first solution of 30 liter is formed;

pouring the first solution into a first foaming tank;

agitating the first solution in the first foaming tank to foam;

adding a bridging agent and a foaming agent to a second foaming tank to mix with water to foam until a second solution having a volume of 100 liter is formed;

pouring the first and second solutions into a third tank to mix and form a coating solution;

continuously conveying a fabric sheet to a top of a platform;

activating a squeegee to spread the coating solution on the fabric sheet to form a cooling layer; and performing a dry setting finish on the fabric sheet coated with the cooling layers.

2. The method of claim 1, wherein the bridging agent is PU resin of CAS No: 26680-22-8, and quantity of the added bridging agent is 2-5% of a sum of volume of the first foaming tank and volume of the second foaming tank.

3. The method of claim 1, wherein the foaming agent is 3,7-dinitroso-1.3.5.7-tetraazabicyclo-nonane N,N, CAS No: 101-25-7, or azodicarbonamide CAS No: 123-77-3, and quantity of the added foaming agent is 1-3% of volume of the second foaming tank.

* * * * *